US008936067B2

(12) United States Patent
Lee et al.

(10) Patent No.: US 8,936,067 B2
(45) Date of Patent: Jan. 20, 2015

(54) CASTING CORE FOR A COOLING ARRANGEMENT FOR A GAS TURBINE COMPONENT

(71) Applicants: Ching-Pang Lee, Cincinnati, OH (US); Benjamin E. Heneveld, Newmarket, NH (US)

(72) Inventors: Ching-Pang Lee, Cincinnati, OH (US); Benjamin E. Heneveld, Newmarket, NH (US)

(73) Assignees: Siemens Aktiengesellschaft, München (DE); Mikro Systems, Inc., Charlottesville, VA (US)

( * ) Notice: Subject to any disclaimer, the term of this patent is extended or adjusted under 35 U.S.C. 154(b) by 98 days.

(21) Appl. No.: 13/658,045

(22) Filed: Oct. 23, 2012

(65) Prior Publication Data

US 2014/0110559 A1 Apr. 24, 2014

(51) Int. Cl.
*B22C 9/10* (2006.01)

(52) U.S. Cl.
USPC ..... 164/369

(58) Field of Classification Search
CPC ..... B22C 9/10; B22C 9/101; B22C 9/103; B22C 9/106
USPC ..... 164/369, 370; 249/175
See application file for complete search history.

(56) References Cited

U.S. PATENT DOCUMENTS

| | | | | |
|---|---|---|---|---|
| 3,819,295 | A | | 6/1974 | Hauser et al. |
| 4,203,706 | A | | 5/1980 | Hess |
| 4,684,322 | A | | 8/1987 | Clifford et al. |
| 5,246,341 | A | | 9/1993 | Hall et al. |
| 5,296,308 | A | * | 3/1994 | Caccavale et al. ..... 428/586 |
| 5,370,499 | A | | 12/1994 | Lee |
| 5,601,399 | A | | 2/1997 | Okpara et al. |
| 5,690,472 | A | | 11/1997 | Lee |
| 5,704,763 | A | | 1/1998 | Lee |
| 5,752,801 | A | | 5/1998 | Kennedy |
| 6,004,095 | A | | 12/1999 | Waitz et al. |
| 6,099,252 | A | | 8/2000 | Manning et al. |
| 6,254,334 | B1 | | 7/2001 | LaFleur |
| 6,402,470 | B1 | | 6/2002 | Kvasnak et al. |
| 6,984,103 | B2 | * | 1/2006 | Lee et al. ..... 415/115 |
| 7,182,576 | B2 | | 2/2007 | Bunker et al. |
| 7,232,290 | B2 | | 6/2007 | Draper et al. |
| 7,311,498 | B2 | | 12/2007 | Cunha et al. |
| 7,435,053 | B2 | | 10/2008 | Liang |
| 7,478,994 | B2 | | 1/2009 | Cunha et al. |
| 7,549,844 | B2 | | 6/2009 | Liang |
| 7,572,103 | B2 | | 8/2009 | Walters et al. |
| 7,625,178 | B2 | * | 12/2009 | Morris et al. ..... 416/97 R |
| 7,670,113 | B1 | | 3/2010 | Liang |
| 7,713,026 | B1 | | 5/2010 | Liang |
| 7,753,650 | B1 | | 7/2010 | Liang |

(Continued)

FOREIGN PATENT DOCUMENTS

| | | | |
|---|---|---|---|
| EP | 1607577 | A1 | 12/2005 |
| GB | 2112467 | A | 7/1983 |

*Primary Examiner* — Kevin P Kerns

(57) ABSTRACT

A ceramic casting core, including: a plurality of rows (162, 166, 168) of gaps (164), each gap (164) defining an airfoil shape; interstitial core material (172) that defines and separates adjacent gaps (164) in each row (162, 166, 168); and connecting core material (178) that connects adjacent rows (170, 174, 176) of interstitial core material (172). Ends of interstitial core material (172) in one row (170, 174, 176) align with ends of interstitial core material (172) in an adjacent row (170, 174, 176) to form a plurality of continuous and serpentine shaped structures each including interstitial core material (172) from at least two adjacent rows (170, 174, 176) and connecting core material (178).

20 Claims, 5 Drawing Sheets

(56) References Cited

U.S. PATENT DOCUMENTS

| | | | | |
|---|---|---|---|---|
| 7,780,414 | B1 | 8/2010 | Liang | |
| 7,785,071 | B1 | 8/2010 | Liang | |
| 8,052,378 | B2 | 11/2011 | Draper | |
| 8,092,175 | B2 | 1/2012 | Beeck et al. | |
| 8,157,504 | B2 | 4/2012 | Amaral et al. | |
| 8,261,810 | B1 | 9/2012 | Liang | |
| 2003/0223862 | A1* | 12/2003 | DeMarche et al. | 415/115 |
| 2004/0076519 | A1* | 4/2004 | Halfmann et al. | 416/97 R |
| 2004/0115053 | A1* | 6/2004 | Shi et al. | 416/97 R |
| 2007/0128032 | A1* | 6/2007 | Lee et al. | 416/97 R |
| 2007/0237639 | A1* | 10/2007 | Cunha et al. | 416/97 R |
| 2008/0056908 | A1* | 3/2008 | Morris et al. | 416/97 R |
| 2008/0101961 | A1 | 5/2008 | Liang et al. | |
| 2008/0138209 | A1* | 6/2008 | Cunha et al. | 416/97 R |
| 2008/0164001 | A1* | 7/2008 | Morris et al. | 164/369 |
| 2009/0317234 | A1* | 12/2009 | Zausner et al. | 415/115 |
| 2010/0008761 | A1 | 1/2010 | Piggush et al. | |
| 2012/0269649 | A1* | 10/2012 | Rawlings et al. | 416/97 R |

* cited by examiner

CASTING CORE FOR A COOLING ARRANGEMENT FOR A GAS TURBINE COMPONENT

STATEMENT REGARDING FEDERALLY SPONSORED DEVELOPMENT

Development for this invention was supported in part by contract Award Number DE-SC0001359 awarded by the United States Department of Energy Office of Science (SBIR) to Mikro Systems, Inc. of Charlottesville, Virginia. Accordingly, the United States Government may have certain rights in this invention.

FIELD OF THE INVENTION

The invention relates to a casting core for forming cooling channels in a gas turbine engine component. In particular the invention relates to a casting core for forming serpentine cooling channels defined by rows of aerodynamic structures.

BACKGROUND OF THE INVENTION

Gas turbine engines create combustion gas which is expanded through a turbine to generate power. The combustion gas is often heated to a temperature which exceeds the capability of the substrates used to form many of the components in the turbine. To address this, the substrates are often coated with thermal barrier coatings (TBC) and also often include cooling passages throughout the component. A cooling fluid such as compressed air created by the gas turbine engine's compressor is typically directed into an internal passage of the substrate. From there, it flows into the cooling passages and exits through an opening in the surface of the component and into the flow of combustion gas.

Certain turbine components are particularly challenging to cool, such as those components having thin sections. The thin sections have relatively large surface area that is exposed to the combustion gas, but a small volume with which to form cooling channels to remove the heat imparted by the combustion gas. Examples of components with a thin section are those having an airfoil, such as turbine blades and stationary vanes. The airfoil usually has a thin trailing edge.

Various cooling schemes have been attempted to strike a balance between the competing factors. For example, some blades use structures in the trailing edge, where cooling air flowing between the structures in a first row is accelerated and impinges on structures in a second row. A faster flow of cooling fluid will more efficiently cool than will a slower flow of the same cooling fluid. This may be repeated to achieve double impingement cooling, and repeated again to achieve triple impingement cooling, after which the cooling air may exit the substrate through an opening in the trailing edge, where the cooling air enters the flow of combustion gas passing thereby. The impingement not only cools the interior surface of the component, but it also helps regulate the flow. In particular it may create an increased resistance to flow along the cooling channel and this may prevent use of excess cooling air.

For cost efficient cooling design the trailing edge is typically cast integrally with the entire blade using a ceramic core. The features and size of the ceramic core are important factors in the trailing edge design. A larger size of a core feature makes casting easier, but the larger features are not optimal for metering the flow through the crossover holes to achieve efficient cooling. In the trailing edge, for example, since cavities in the substrate correspond to core material, a crossover holes between the adjacent pin fins in a row corresponds to sparse casting core material in that location of the casting. This, in turn, leads to fragile castings that may not survive normal handling. To achieve acceptable core strength the crossover holes must exceed a size optimal for cooling efficiency purposes. However, the crossover holes result in more cooling flow which is not desirable for turbine efficiency. Consequently, there remains room in the art for improvement.

BRIEF DESCRIPTION OF THE DRAWINGS

The invention is explained in the following description in view of the drawings that show.

DETAILED DESCRIPTION OF THE INVENTION

The present inventors have devised an innovative cooling arrangement for use in a cooled component and a casting core that may be used to effect the cooling arrangement when a casting process is used to create the component. The component may alternately be manufactured via machining, or using sheet material. Sheet material may be particularly useful in a component such as a transition duct. The cooling arrangement may include cooling channels characterized by a serpentine or zigzag flow axis, where the cooling channel walls are defined by rows of discrete aerodynamic structures that form continuous cooling channels having discontinuous walls. The aerodynamic structures may be airfoils or the like. The cooling channels may further include other cooling features such as turbulators, and may further be defined by other structures such as pin fins or mesh cooling passages. The cooled component may include items such as blades, vanes, and transition ducts etc that have thin regions with relatively larger surface area. An example of such a thin area is a trailing edge of the blade or vane, but is not limited to these thin areas or to these components.

The cooling arrangement disclosed herein enables highly efficient cooling by providing increased surface area for cooling and sufficient resistance to the flow of cooling air while also enabling a core design of greater strength. Traditional flow restricting impingement structures regulated an amount of cooling fluid used by restricting the flow, and this restriction also accelerated the flow in places. A faster moving flow provides a higher heat transfer coefficient, which, in turn, improves cooling efficiency. In the cooling arrangement disclosed herein, the serpentine cooling channels provide sufficient resistance to the flow to obviate the need for the flow restricting effect of the traditional impingement structures. The increased surface area and associated increase in cooling channel length yields an increase in cooling, despite the relatively slower moving cooling fluid having a relatively lower heat transfer coefficient when compared to the faster moving fluid of the impingement-based cooling schemes. The result is that the cooling arrangement disclosed herein yields an increase in overall heat transfer because the positive effect of the increase in surface area more than overcomes the negative effect of the decreased heat transfer coefficient. The satisfactory flow resistance offered by the serpentine shape of the cooling channel is sufficient to regulate the flow and thereby enable the cooling arrangement, with or without the assistance of an array of pin fins or the like. Experimental data indicated upwards of a 40 degree Kelvin temperature drop at a point on the surface of the blade when the cooling arrangement disclosed herein is implemented.

Figure 1:
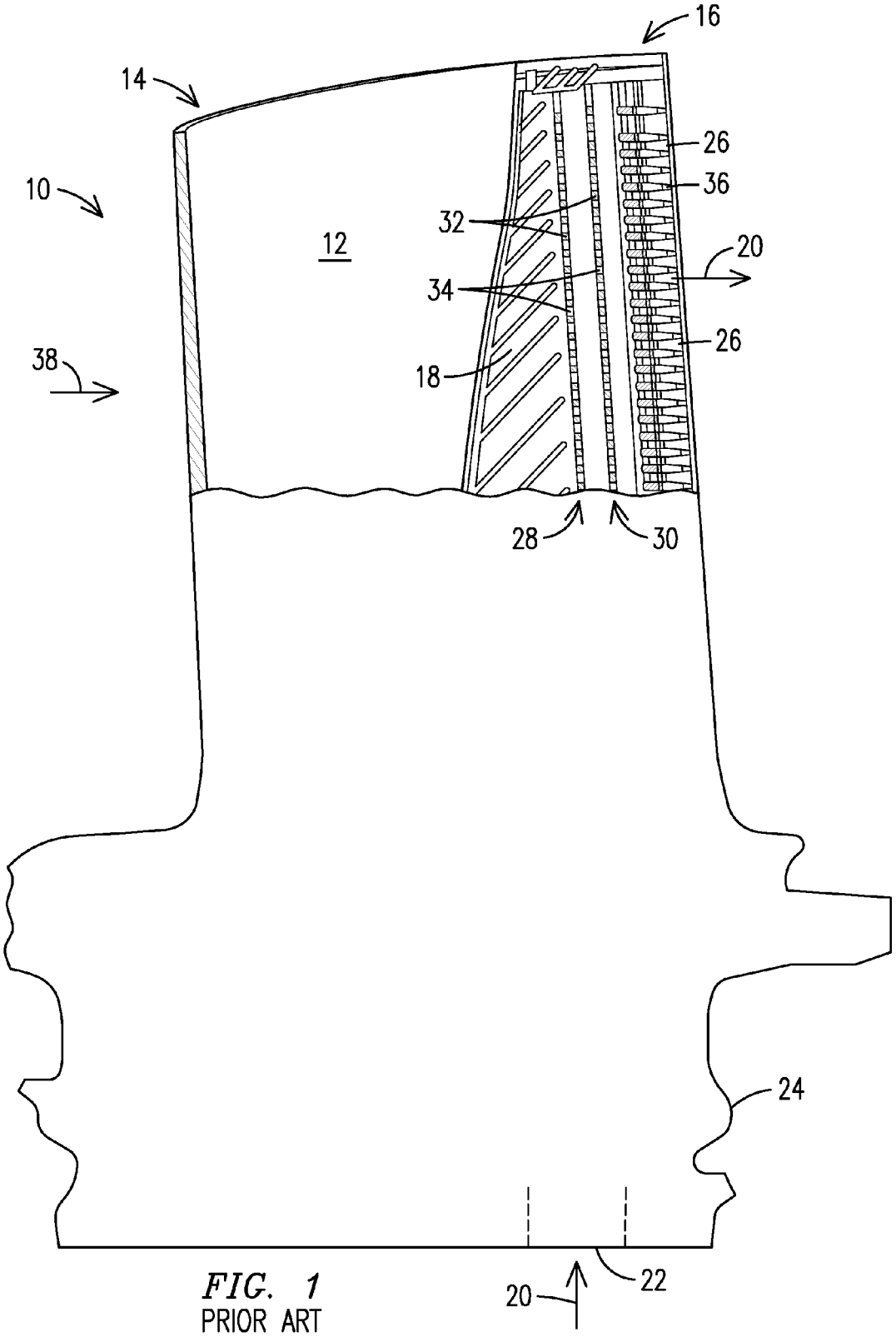
FIG. 1 PRIOR ART
FIG. 1 is a cross sectional side view of a prior art turbine blade.

FIG. 1 shows a cross section of a prior art turbine blade 10 with an airfoil 12, a leading edge 14 and a trailing edge 16. The prior art turbine blade 10 includes a trailing edge radial cavity 18. Cooling fluid 20 enters the trailing edge radial cavity 18 through an opening 22 in a base 24 of the prior art turbine blade 10. The cooling fluid 20 travels radially outward and then travels toward exits 26 in the trailing edge 16. As the cooling fluid 20 travels toward the trailing edge exit 26 it encounters a first row 28 and a second row 30 of crossover hole structures 32. The cooling fluid 20 flows through relatively narrow crossover holes 34 between the crossover hole structures 32 of the first row 28, which accelerates the cooling fluid which, in turn, increases the heat transfer coefficient in a region where the accelerated fluid flows. The cooling fluid 20 impinges on the crossover hole structures 32 of the second row 30, and is again accelerated through crossover holes 34 between the crossover hole structures 32 of the second row 30. Here again the accelerated fluid results in a higher heat transfer coefficient in the region of accelerated fluid flow. The cooling fluid 20 then impinges on a final structure 36 which keep the fluid flowing at a fast rate before exiting the prior art turbine blade 10 through the trailing edge exits 26 where the cooling fluid 20 joins a flow of combustion gas 38 flowing thereby. Between the trailing edge radial cavity 18 and the trailing edge exit 26 individual flows between the crossover hole structures 32 may be subsequently split when impinging another crossover hole structures 32 or final structure 36, and split flows may be joined with other adjacent split flows. Consequently, it is difficult to describe the cooling arrangement in the prior art trailing edge 16 as continuous cooling channels; it is better characterized as a field of structures that define discontinuous pathways where individual flows of cooling fluid 20 split and merge at various locations throughout.

Figure 2:
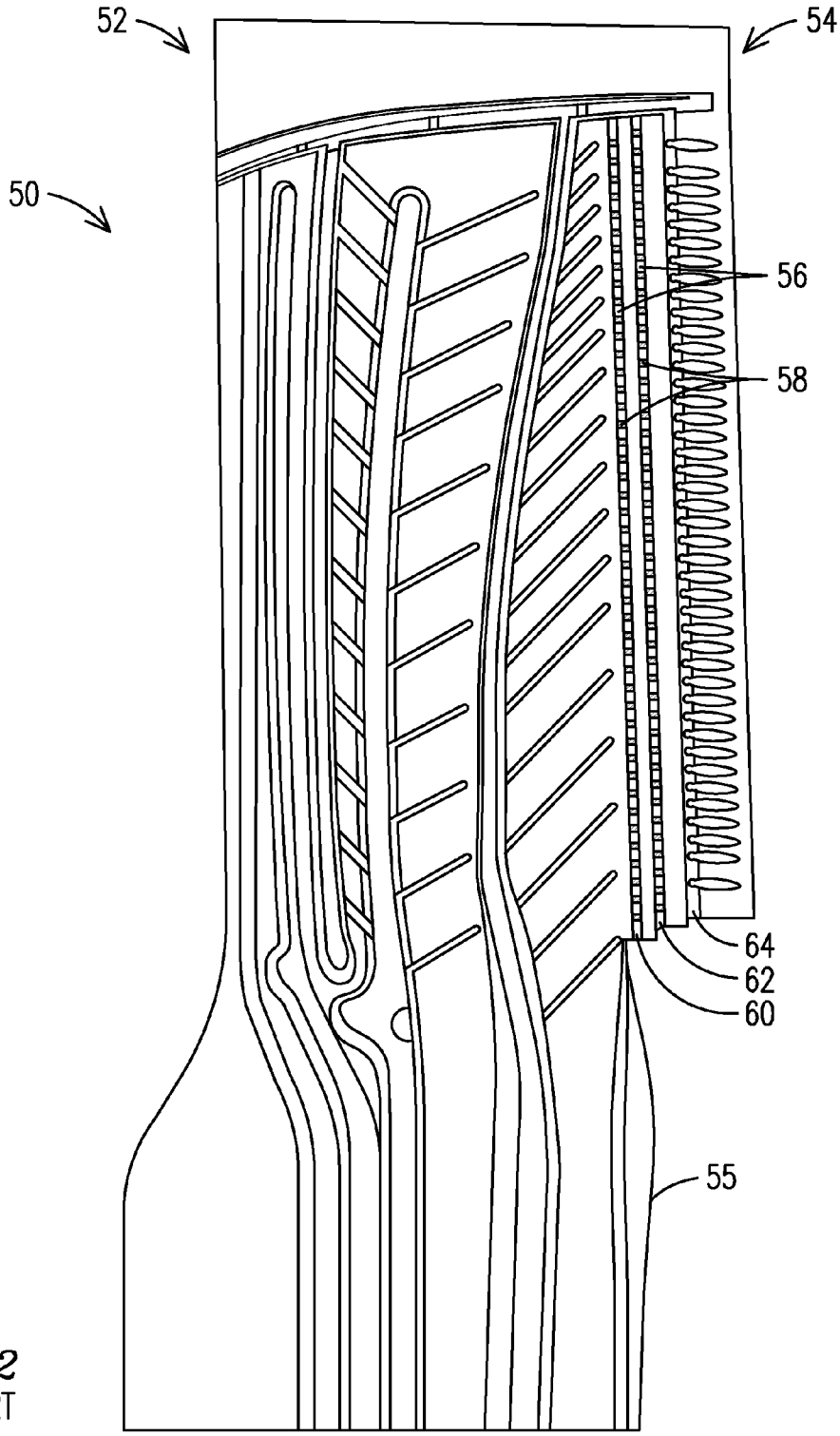
FIG. 2 PRIOR ART
FIG. 2 shows a core used to manufacture the prior art turbine blade shown in FIG. 1.

FIG. 2 shows a prior art core 50 with a core leading edge 52 and a core trailing edge 54 and a core base 55. During manufacture a substrate material (not shown) may be cast around the prior art core 50. The solidified cast material becomes the substrate of the component. The prior art core 50 is removed by any of several methods known to those of ordinary skill in the art. What remains once the prior art core 50 is removed is a hollow interior that forms the trailing edge radial cavity 18 and the crossover holes 34, among others. For example, core crossover hole structure gaps 56 are openings in the prior art core 50 which will be filled with substrate material and form crossover hole structures 32 in the prior art blade 10 (or vane etc). Conversely, core crossover hole structures 58 between the core crossover hole structure gaps 56 will block material in the substrate so that once the prior art core 50 is removed the crossover holes 34 will be formed. It can be seen that the core crossover hole structures 58 are relatively small in terms of depth (into the page) and height (y axis on the page) and provide a weak regions 60, 62, 64 that correspond to locations in the prior art core 50 that form the first row 28, the second row 30, and the row of final structures 36 in the finished prior art turbine blade 10. These weak regions 60, 62, and 64 may break prior to casting of the substrate material and this is costly in terms of material and lost labor etc.

Figure 3:
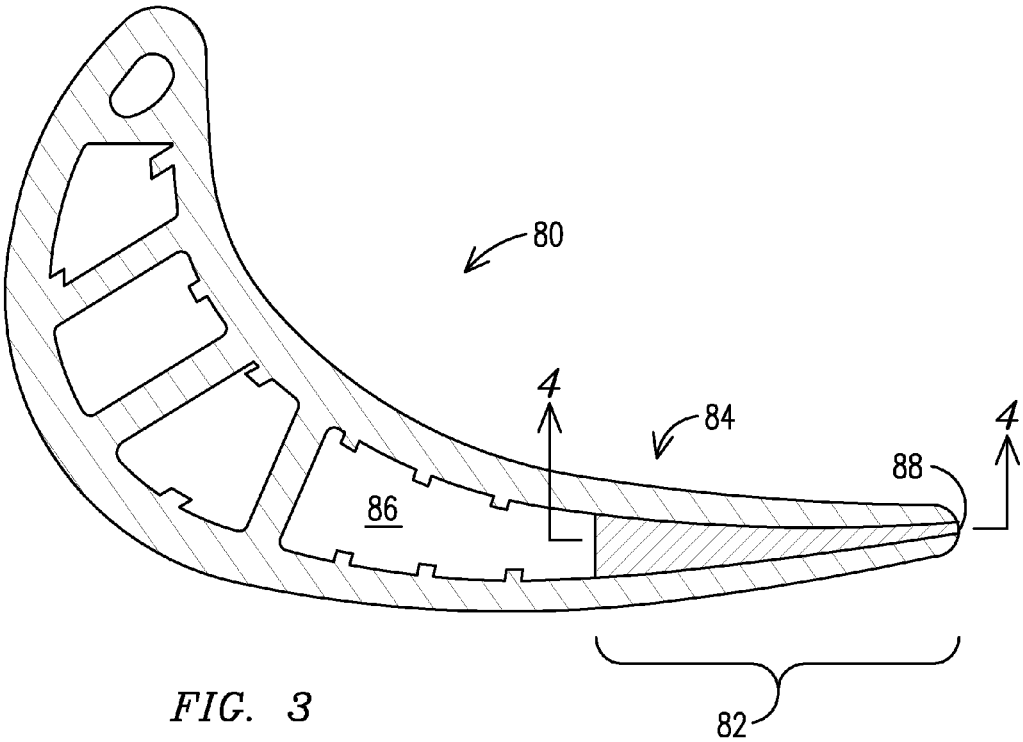
FIG. 3 is a cross sectional end view of a turbine blade.

FIG. 3 is a cross sectional end view of a turbine blade 80 having the cooling arrangement 82 disclosed herein in a trailing edge 84 of the turbine blade 80. The cooling arrangement 82 is not limited to a trailing edge 84 of a turbine blade 80, but can be disposed in any location where there exists a relatively large surface area to be cooled. In the exemplary embodiment shown the cooling arrangement 82 spans from the trailing edge radial cavity 86 to the trailing edge exits 88.

Figure 4:
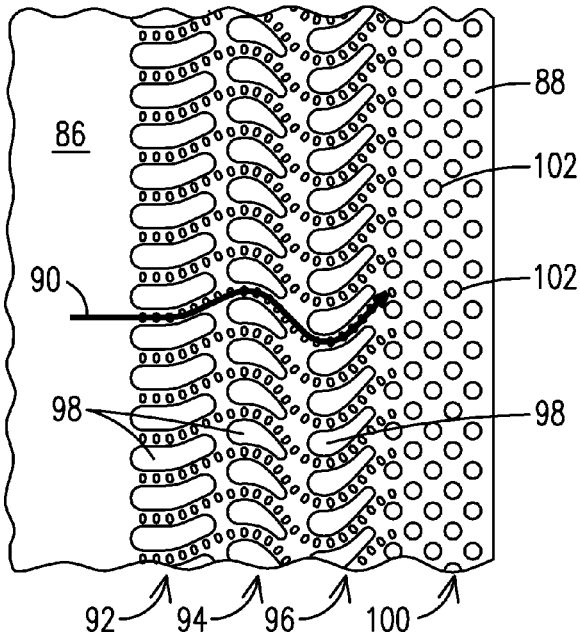
FIG. 4 is a partial cross sectional side view along 4-4 of the turbine blade of FIG. 3 showing the cooling channels disclosed herein.

FIG. 4 is a partial cross sectional side view along 4-4 of the turbine blade 80 of FIG. 3 showing cooling channels 90 of the cooling arrangement 82. In the exemplary embodiment shown the cooling channels 90 are defined by a first row 92, a second row 94, and a third row 96 of flow defining structures 98 and are continuous and discrete paths for a cooling fluid. However, each cooling channel 90 is not continuously bounded by flow defining structures 98. Instead, between rows 92, 94, 96 of flow defining structures 98 each cooling channel 90 is free to communicate with an adjacent cooling channel 90. Downstream of the cooling channels 90 there may be an array 100 of pin fins 102 or other similar structures used to enhance cooling, meter the flow of cooling fluid, and provide strength to both the turbine blade 80 and the prior art core 50. In the exemplary embodiment shown the flow defining segments 98 take the form of an airfoil, but other shapes may be used.

Figure 5:
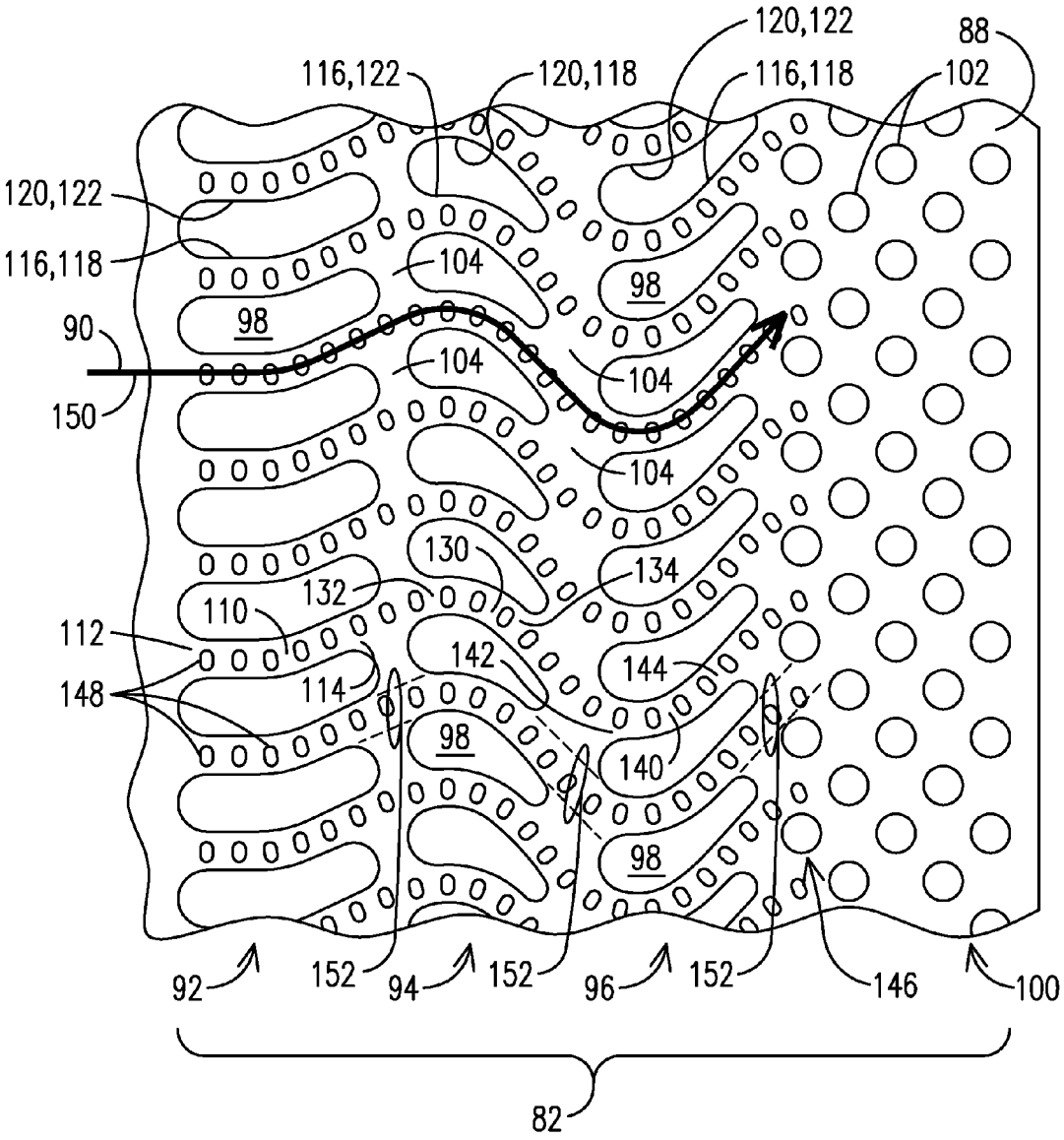
FIG. 5 is a close up view of the cooling arrangement of FIG. 4.

FIG. 5 is a close up view of the cooling arrangement 82 of FIG. 4. Each cooling channel 90 includes at least two segments where the cooling channel is bounded by flow defining structures 98 that provide bounding walls. In between segments the cooling channel 90 may be unbounded by walls where cross paths 104 permit fluid communication between adjacent cooling channels 90 and contribute to an increase in surface area available for cooling inside the turbine blade 80. The cooling channels may open into the array 100 of pin fins 102. In the exemplary embodiment shown there are three rows 92, 94, 96, of flow defining structures 98, and hence three segments per cooling channel 90.

The first row 92 of flow defining structures 98 defines a first segment 110 having a first segment inlet 112 and a first segment outlet 114. In the first row 92 a first wall 116 of the cooling channel 90 is defined by a suction side 118 of the flow defining structure 98. A second wall 120 of the cooling channel 90 is defined by a pressure side 122 of the flow defining structure 98. Between the first row 92 and the second row 94 the cooling channel is not bounded by walls, but is instead open to adjacent channels via the cross paths 104.

The second row 94 of flow defining structures 98 defines a second segment 130 having a second segment inlet 132 and a second segment outlet 134. In the second row 94 the first wall 116 of the cooling channel 90 is now defined by a pressure side 122 of the flow defining structure 98. The second wall 120 of the cooling channel 90 is now defined by the suction side 118 of the flow defining structure 98. Between the second row 94 and the third row 96 the cooling channel is not bounded by walls, but is instead open to adjacent channels via the cross paths 104.

The third row 96 of flow defining structures 98 defines a third segment 140 having a third segment inlet 142 and a third segment outlet 144. In the third row 96 the first wall 116 of the cooling channel 90 is defined by a suction side 118 of the flow defining structure 98. The second wall 120 of the cooling channel 90 is defined by a pressure side 122 of the flow defining structure 98. The cooling channel 90 ends at the third segment outlet 144, where the cooling channel may open to the array 100 of pin fins 102. The array 100 of pin fins 102 may or may not be included in the cooling arrangement 82.

Unlike conventional impingement based cooling arrangements, the instant cooling arrangement 82 aligns the outlets and inlets of the segments so that cooling air exiting an outlet is aimed toward the next segment's inlet. This aiming may be done along a line of sight (mechanical alignment), or it may be configured to take into account the aerodynamic effects present during operation. In a line of sight/mechanical alignment an axial extension 152 of an outlet in a flow direction will align with an inlet of the next/downstream inlet. An aerodynamic alignment may be accomplished, for instance, via fluid modeling etc. In such instances an axial extension of an outlet may not align exactly mechanically with an inlet of the next/downstream inlet, but in operation the fluid exiting the outlet will be directed toward the next inlet in a manner that accounts for aerodynamic influences, such as those generated by adjacent flows, or rotation of the blade etc. It is understood that the cooling fluid may not exactly adhere to the path an axial extension may take, or a path on which it is aimed in an aerodynamic alignment, but it is intended that the fluid will flow substantially from an outlet to the next inlet. Essentially, the fluid may be guided to avoid or minimize impingement, contrary to the prior art.

This aiming technique may also be applied to cooling fluid exiting the third segment outlet 144 at the end of the cooling channel 90. In particular an axial extension of the third segment outlet 144 may be aimed between pin fins 102 in a first row 146 of pin fins 102 in the array 100. Likewise the flow exiting the third segment outlet 144 may be aerodynamically aimed between the pin fins 102 in the first row 146. Still further, downstream rows of pin fins may or may not align to permit an axial extension of the third segment outlet 144 to extend uninterrupted all the way through the trailing edge exits 88. The described configuration results in a cooling channel 90 with a serpentine flow axis 150. The serpentine shape may include a zigzag shape.

The cooling channels 90 may have turbulators to enhance heat transfer. In the exemplary embodiment shown the cooling channels 90 include mini ribs, bumps or dimples 148. Alternatives include other shapes known to those of ordinary skill in the art. These turbulators increase surface area and introduce turbulence into the flow, which improves heat transfer.

Figure 6:
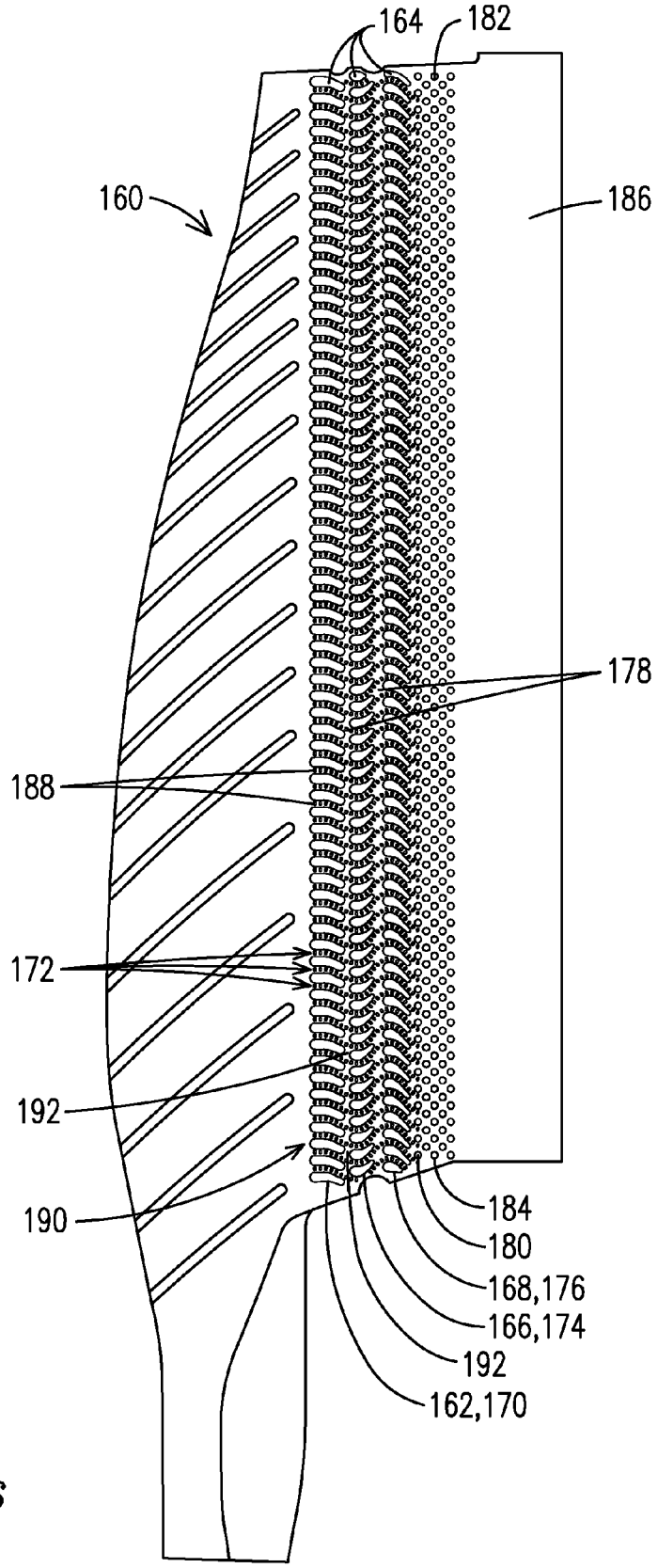
FIG. 6 shows a portion of a core used to manufacture the turbine blade of FIG. 4.

FIG. 6 shows an improved portion 160 of an improved core, the improved portion 160 being for the trailing edge radial cavity 86 and designed to create the cooling arrangement 82 disclosed herein. (The remainder of the improved core would remain the same as shown in FIG. 2.) A first row 162 of core flow defining structure gaps 164, a second row 166 of core flow defining gaps 164, and a third row 168 of core flow defining gaps 164 are present in the improved core portion 160 where the first row 92, the second row 94, and the third row 96 of flow defining structures 98 respectively will be formed in the cast component. A first row 170 of interstitial core material 172 separates the core flow defining structure gaps 164 in the first row 162 from each other. A second row 174 of interstitial core material 172 separates the core flow defining structure gaps 164 in the second row 166 from each other. A third row 176 of interstitial core material 172 separates the core flow defining structure gaps 164 in the third row 166 from each other. Each row (170, 174, 176) of interstitial core material is connected to an adjacent row with connecting core material 178 that spans the rows (170, 174, 176) of interstitial core material. A first row 180 of core pin fin gaps 182 begins an array 184 of pin fin gaps 182 where the first row 146 of pin fins 102 and the array 100 of pin fins 102 will be formed in the cast component. Also visible are core turbulator features 188 where mini ribs, bumps or dimples 148 will be present on the cast component. The improved portion 160 may also include surplus core material 186 as necessary to aid the casting process.

When compared to the trailing edge portion of the prior art core 50 of FIG. 2, it can be seen that the improved core portion 160 is structurally more sound than the trailing edge portion of the prior art core 50. In particular, the improved core portion 160 does not have the weak regions 60, 62, 64 which include material that is relatively small in terms of depth (into the page) and height (y axis on the page). Instead, the rows 170, 174, 176 of interstitial core material 172 are present between the core flow defining structure gaps 162 in the improved core portion, and the interstitial core material 172 has a same depth as the flow defining structure gaps 162 themselves (i.e. the interstitial core material 172 is as thick as the bulk of the improved core portion 160) and thus the improved core portion 160 is stronger than the prior art design.

Stated another way, a first region 190 immediately upstream of a respective row of the interstitial core material 172 has a first region thickness. A second region 192 immediately downstream of a respective row of the interstitial core material 172 has a second region thickness. The interstitial core material 172 between the first region and the second region has an upstream interstitial core material thickness that matches the first region thickness because they blend together at an upstream end of the interstitial core material 172. The interstitial core material 172 has a downstream interstitial core material thickness that matches the second region thickness because they blend together at a downstream end of the interstitial core material 172. The interstitial core material 172 maintains a maximum thickness between the upstream end and the downstream end. This configuration is the same for all of the rows 170, 174, 176 of interstitial core material 172. Since there is no reduction in thickness of the improved core portion 160 where the interstitial core material 172 is present, the improved core portion 160 is much stronger than the prior art core portion 50. This reduces the chance of core fracture and provides lower manufacturing costs associated there with. Furthermore, the relatively larger cooling passages disclosed herein are less susceptible to clogging from debris that may find its way into the cooling passage than the crossover holes of the prior art configuration.

The cooling arrangement disclosed herein replaces the impingement cooling arrangements of the prior art which accelerate the flow to increase the cooling efficiency with a cooling arrangement having serpentine cooling channels. The serpentine channels provide sufficient resistance to flow to enable efficient use of compressed air as a cooling fluid, and the increased surface area improves an overall heat transfer quotient of the cooling arrangement. Further, the improved structure can be cast using the casting core with improved core strength. As a result, cooling efficiency is improved and manufacturing costs are reduced. Consequently, this cooling arrangement represents improvements in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A ceramic casting core, comprising:

a plurality of rows of gaps, each gap individually in a configuration of an airfoil shape;

interstitial core material that defines and separates adjacent gaps in each row; and connecting core material that connects adjacent rows of interstitial core material, wherein ends of interstitial core material in one row align with ends of interstitial core material in an adjacent row to form a plurality of continuous and serpentine shaped structures each comprising interstitial core material from at least two adjacent rows and connecting core material, the serpentine shaped structures arranged to form respective cooling channels in the cast component, wherein the interstitial core material comprises turbulator features arranged to form a successive stream of turbulators along respective serpentine flow axes of the respective serpentine shaped structures that form the respective cooling channels in the cast component.

2. The ceramic casting core of claim 1, wherein the interstitial core material is at least as thick as a thinner of: a thickness of the ceramic casting core at a first region immediately upstream of a respective row of the interstitial core material, and a thickness of the ceramic casting core at a second region immediately downstream of the respective row of the interstitial core material.

3. The ceramic casting core of claim 1, further comprising core pin fin gaps adjacent a last row of gaps.

4. The ceramic casting core of claim 1, wherein the turbulator features are configured to form turbulators selected from the group consisting of bumps, dimples and mini-ribs.

5. A casting core for manufacturing a gas turbine engine airfoil, the casting core comprising:

a first row of core flow defining structure gaps, each gap individually in a configuration of a respective airfoil shape for forming a first row of flow defining structures in a cast component, wherein in the cast component, adjacent first row flow defining structures form respective first segments of respective cooling channels;

a second row of core flow defining structure gaps, each gap individually in a configuration of a respective airfoil shape for forming a second row of flow defining structures in the cast component, wherein in the cast component adjacent second row flow defining structures form respective second segments of the respective cooling channels;

wherein in the cast component, an axial extension of an outlet of each respective first segment aligns with an inlet of the respective second segment to define the respective cooling channel, each cooling channel comprising a serpentine flow axis, and core turbulator features arranged to form a successive stream of turbulators along respective serpentine flow axes of the cooling channels of the cast component.

6. The casting core of claim 5, further comprising interstitial core material in each row between flow defining structure gaps, wherein the interstitial core material is at least as thick as a thinner of: a thickness of the casting core at a first region immediately upstream of a respective row of the interstitial core material, and a thickness of the casting core at a second region immediately downstream of the respective row of the interstitial core material.

7. The casting core of claim 5, further comprising a third row of core flow defining structure gaps for forming a third row of flow defining structures in the cast component, wherein in the cast component adjacent third row flow defining structures form respective third segments of the respective cooling channels; and wherein in the cast component outlets of the second segments align aerodynamically with respective inlets of the third segments to further define the cooling channels.

8. The casting core of claim 5, further comprising core pin fin gaps for forming pin fins in the cast component downstream of a last row of segment defining structures.

9. The casting core of claim 5, further comprising a row of pin fin gaps for forming in the cast component a row of pin fins downstream of a last row of airfoils, wherein in the cast component the respective last row airfoils cooperate to aerodynamically aim a respective flow of cooling air at a respective space between individual pin fins.

10. The casting core of claim 5, wherein in the cast component at least one non-continuous wall of each cooling channel alternates between being defined by a pressure side of an airfoil and a suction side of an airfoil in a direction of flow.

11. The casting core of claim 5, wherein in the cast component the serpentine flow axis defines a zigzag shape.

12. The casting core of claim 5, wherein the cast component comprises a blade or vane, and wherein the rows of airfoils are disposed in a trailing edge of the blade or vane.

13. The casting core of claim 5, wherein the turbulator features are configured to form turbulators selected from the group consisting of bumps, dimples and mini-ribs.

14. A casting core for manufacturing a gas turbine engine air-foil, the casting core comprising:

a plurality of rows of flow defining structure gaps, each gap individually in a configuration of a respective airfoil shape for forming a plurality of rows of segment defining structures in a cast component, wherein in the cast component adjacent segment defining structures within a row define segments of cooling channels, wherein in the cast component adjacent segment defining structures of an upstream one of the rows are configured to aerodynamically aim a flow of cooling air exiting the respective segment of the upstream row toward an inlet of a respective single segment of a downstream row, and wherein in the cast component each cooling channel defines a serpentine flow axis, wherein the casting core comprises turbulator features arranged to form a successive stream of turbulators along the respective serpentine flow axes formed in the cooling channels of the cast component.

15. The casting core of claim 14, further comprising interstitial core material in each row of segment defining structures and between flow defining structure gaps, wherein the interstitial core material is at least as thick as a thinner of: a thickness of the casting core at a first region immediately upstream of a respective row of the interstitial core material into which the interstitial core material blends, and a thickness of the casting core at a second region immediately downstream of the respective row of the interstitial core material into which the interstitial core material blends.

16. The casting core of claim 14, wherein in the cast component the segment defining structures each comprise an airfoil shape.

17. The casting core of claim 14, wherein in the cast component at least one non-continuous wall of each cooling channel alternates between being defined by a pressure side of an airfoil and a suction side of an airfoil in a direction of flow.

18. The casting core of claim 14, further comprising pin fin gaps for forming pin fins downstream of a last row of segment defining structures in the cast component.

19. The casting core of claim 14, wherein the cast component comprises an airfoil, and wherein the plurality of rows of segment defining structures is disposed in a trailing edge of the airfoil.

20. The casting core of claim 14, wherein the turbulator features are configured to form turbulators selected from the group consisting of bumps, dimples and mini-ribs.

* * * * *